US010889880B2

(12) United States Patent
Imamura et al.

(10) Patent No.: US 10,889,880 B2
(45) Date of Patent: Jan. 12, 2021

(54) GRAIN-ORIENTED ELECTRICAL STEEL SHEET AND METHOD FOR MANUFACTURING SAME

(71) Applicant: JFE STEEL CORPORATION, Tokyo (JP)

(72) Inventors: Takeshi Imamura, Tokyo (JP); Masanori Takenaka, Tokyo (JP); Yuiko Wakisaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 627 days.

(21) Appl. No.: 15/554,051

(22) PCT Filed: Mar. 4, 2016

(86) PCT No.: PCT/JP2016/057689
§ 371 (c)(1),
(2) Date: Aug. 28, 2017

(87) PCT Pub. No.: WO2016/140373
PCT Pub. Date: Sep. 9, 2016

(65) Prior Publication Data

US 2018/0066346 A1 Mar. 8, 2018

(30) Foreign Application Priority Data

Mar. 5, 2015 (WO) ..... PCT/JP2015/057224

(51) Int. Cl.
*C21D 9/46* (2006.01)
*C22C 38/60* (2006.01)
(Continued)

(52) U.S. Cl.
CPC ..... *C22C 38/60* (2013.01); *C21D 1/78* (2013.01); *C21D 1/84* (2013.01); *C21D 6/005* (2013.01);
(Continued)

(58) Field of Classification Search
CPC ..... C21D 9/46
See application file for complete search history.

(56) References Cited

U.S. PATENT DOCUMENTS 8,535,455 B2 9/2013 Takashima et al.
9,290,824 B2 3/2016 Watanabe et al.
(Continued)

FOREIGN PATENT DOCUMENTS

CA 2802019 A1 12/2011
CA 2808774 A1 3/2012
(Continued)

OTHER PUBLICATIONS

Aug. 6, 2019, Office Action issued by the United States Patent and Trademark Office in the U.S. Appl. No. 15/549,578.
(Continued)

*Primary Examiner* — Jophy S. Koshy
(74) *Attorney, Agent, or Firm* — Kenja IP Law PC

(57) ABSTRACT

Provided are a grain-oriented electrical steel sheet with low iron loss even when including at least one grain boundary segregation element among Sb, Sn, Mo, Cu, and P, and a method for manufacturing the same. In our method, Pr is controlled to satisfy $Pr \leq -0.075T+18$, where $T>10$, $5<Pr$, T (hr) is the time required after final annealing to reduce the temperature of a secondary recrystallized sheet from 800° C. to 400° C., and Pr (MPa) is the line tension on the secondary recrystallized sheet during flattening annealing. As a result, a grain-oriented electrical steel sheet in which iron loss is low and a dislocation density near crystal grain boundaries of the steel substrate is $1.0\times10^{13}$ $m^{-2}$ or less can be obtained even when the grain-oriented electrical steel sheet contains at least one of Sb, Sn, Mo, Cu, and P.

18 Claims, 4 Drawing Sheets

(51) Int. Cl.

| | |
|---|---|
| ***H01F 1/16*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/16*** | (2006.01) |
| ***C21D 1/78*** | (2006.01) |
| ***C22C 38/18*** | (2006.01) |
| ***C22C 38/20*** | (2006.01) |
| ***C22C 38/34*** | (2006.01) |
| ***C22C 38/08*** | (2006.01) |
| ***C22C 38/22*** | (2006.01) |
| ***C21D 1/84*** | (2006.01) |
| ***C21D 6/00*** | (2006.01) |

(52) U.S. Cl.

CPC ..... *C21D 8/12* (2013.01); *C21D 8/125* (2013.01); *C21D 8/1244* (2013.01); *C21D 8/1272* (2013.01); *C21D 8/1277* (2013.01); *C21D 8/1283* (2013.01); *C21D 8/1288* (2013.01); *C21D 9/46* (2013.01); *C22C 38/008* (2013.01); *C22C 38/02* (2013.01); *C22C 38/04* (2013.01); *C22C 38/08* (2013.01); *C22C 38/12* (2013.01); *C22C 38/16* (2013.01); *C22C 38/18* (2013.01); *C22C 38/20* (2013.01); *C22C 38/22* (2013.01); *C22C 38/34* (2013.01); *H01F 1/16* (2013.01); *C21D 6/001* (2013.01); *C21D 6/002* (2013.01); *C21D 6/004* (2013.01); *C21D 6/008* (2013.01); *C21D 8/1266* (2013.01); *C21D 2201/05* (2013.01)

(56) References Cited

U.S. PATENT DOCUMENTS

| | | | | |
|---|---|---|---|---|
| 9,330,839 | B2 | 5/2016 | Omura et al. | |
| 9,396,872 | B2 | 7/2016 | Inoue et al. | |
| 2009/0199935 | A1 | 8/2009 | Sakakura et al. | |
| 2013/0129984 | A1 | 5/2013 | Omura et al. | |
| 2013/0129985 | A1 | 5/2013 | Inoue et al. | |
| 2013/0130043 | A1* | 5/2013 | Omura ..... | C21D 8/1255 428/450 |

FOREIGN PATENT DOCUMENTS

| | | | | |
|---|---|---|---|---|
| CA | 2900111 | A1 | 9/2014 | |
| CN | 101784698 | A | 7/2010 | |
| CN | 103025903 | A | 4/2013 | |
| CN | 103080351 | A | 5/2013 | |
| CN | 103687967 | A | 3/2014 | |
| EP | 2182091 | A1 | 5/2010 | |
| EP | 2602340 | A1 | 6/2013 | |
| EP | 2602345 | A1 | 6/2013 | |
| JP | H05320769 | A | 12/1993 | |
| JP | H06158167 | A | 6/1994 | |
| JP | H06220540 | A | 8/1994 | |
| JP | H09104923 | A | 4/1997 | |
| JP | 3357615 | B2 | 12/2002 | |
| JP | 2003166018 | A | 6/2003 | |
| JP | 2004353036 | A | 12/2004 | |
| JP | 2012036446 | A | 2/2012 | |
| JP | 2012036447 | A | 2/2012 | |
| JP | 2012052233 | A | 3/2012 | |
| JP | 5001611 | B2 | 8/2012 | |
| JP | 2012177162 | A | 9/2012 | |
| JP | 2012219295 | A | 11/2012 | |
| JP | 2013087299 | A | 5/2013 | |
| JP | 2014196536 | A | 10/2014 | |
| WO | WO-2012017655 | A1 * | 2/2012 | ..... C21D 1/773 |

OTHER PUBLICATIONS

Dec. 12, 2017, Notification of Reasons for Refusal issued by the Japan Patent Office in the corresponding Japanese Patent Application No. 2017-503745 with English language Concise Statement of Relevance.

Dec. 6, 2017, Extended European Search Report issued by the European Patent Office in the corresponding European Patent Application No. 16759063.7.

Jun. 14, 2016, International Search Report issued in the International Patent Application No. PCT/JP2016/057689.

Dec. 13, 2019, Office Action issued by the United States Patent and Trademark Office in the U.S. Appl. No. 15/549,578.

Jun. 5, 2018, Office Action issued by the State Intellectual Property Office in the corresponding Chinese Patent Application No. 201680013069.5 with English language Search Report.

Nov. 13, 2018, Office Action issued by the Korean Intellectual Property Office in the corresponding Korean Patent Application No. 10-2017-7024912 with English language Concise Statement of Relevance.

Sep. 17, 2018, Office Action issued by the Canadian Intellectual Property Office in the corresponding Canadian Patent Application No. 2,977,208.

Apr. 20, 2020, Office Action issued by the United States Patent and Trademark Office in the U.S. Appl. No. 15/549,578.

Sreevathsan Ramanathan, Study of dislocations from continuous flattening anneal and its effect on magnetic properties of grain oriented electrical steel, A thesis submitted to the Cardiff University in candidature for the degree of Doctor of Philosophy, 2013.

* cited by examiner

GRAIN-ORIENTED ELECTRICAL STEEL SHEET AND METHOD FOR MANUFACTURING SAME

TECHNICAL FIELD

This disclosure relates to a grain-oriented electrical steel sheet that has low iron loss and is suitable as an iron core material in a transformer, and to a method for manufacturing the same.

BACKGROUND

A grain-oriented electrical steel sheet is a soft magnetic material used as an iron core material of transformers, generators, and the like, and has a crystal microstructure in which the <001> orientation, which is an easy magnetization axis of iron, is accorded with the rolling direction of the steel sheet. Such a crystal microstructure is formed by preferentially causing the growth of giant crystal grains in {110}<001> orientation, which is called Goss orientation, when final annealing for secondary recrystallization is performed in the process of manufacturing the grain-oriented electrical steel sheet.

It has been common practice in manufacturing grain-oriented electrical steel sheets to use precipitates called inhibitors during final annealing to cause secondary recrystallization of crystal grains with the Goss orientation. Examples of this method that have been put into practical use include a method for using AlN and MnS and a method for using MnS and MnSe. While requiring the slab to be reheated to a temperature of 1300° C. or higher, these methods for using inhibitors are extremely useful for stably causing growth of secondary recrystallized grains.

Furthermore, in order to reinforce the action of these inhibitors, a method for using Pb, Sb, Nb, and Te and a method for using Zr, Ti, B, Nb, Ta, V, Cr, and Mo are also known. JP 3357615 B2 (PTL 1) discloses a method for using Bi, Sb, Sn, and P, which are grain boundary segregation elements, in addition to the use of nitrides as inhibitors. JP 5001611 B2 (PTL 2) discloses a method for obtaining good magnetic properties by using Sb, Nb, Mo, Cu, and Sn, which are elements that precipitate at grain boundaries, even when manufacturing at a thinner slab thickness than normal.

CITATION LIST

Patent Literature

PTL 1: JP 3357615 B2
PTL 2: JP 5001611 B2
PTL 3: JP 2012-177162 A
PTL 4: JP 2012-36447 A

SUMMARY

Technical Problem

In recent years, magnetic properties have increasingly improved, and there is demand for manufacturing of grain-oriented electrical steel sheets that stably achieve a high level of magnetic properties. However, even when adding at least one of Sb, Sn, Mo, Cu, and P, which are grain boundary segregation elements, in order to improve magnetic properties, there has been a significant problem in that the magnetic properties do not actually improve, and low iron loss cannot be obtained.

Therefore, it would be helpful to provide a grain-oriented electrical steel sheet with low iron loss even when including at least one of Sb, Sn, Mo, Cu, and P, which are grain boundary segregation elements, and a method for manufacturing the same.

Solution to Problem

In general, when improving magnetic properties by using precipitates that are called inhibitors during the manufacturing process, these precipitates block displacement of the domain wall in the finished product, causing the magnetic properties to deteriorate. Therefore, final annealing is performed under conditions that allow N, S, Se, and the like, which are precipitate forming elements, to be discharged from the steel substrate either to the coating or outside of the system. In other words, the final annealing is performed for between several hours and several tens of hours at a high temperature of approximately 1200° C. under an atmosphere mainly composed of $H_2$. By this treatment, the N, S, and Se in the steel substrate diminish to the analytical limit or below, and good magnetic properties can be ensured in the finished product, without formation of precipitates.

On the other hand, when at least one of Sb, Sn, Mo, Cu, and P, which are grain boundary segregation elements, is included in the slab, these elements are not displaced in the coating or ejected from the system during the final annealing. Accordingly, we thought that these elements might have some sort of effect that makes magnetic properties unstable during flattening annealing. According to our observations, many dislocations occur near crystal grain boundaries in a grain-oriented electrical steel sheet with degraded magnetic properties. The reason is thought to be that Sb, Sn, Mo, Cu, and P segregate at grain boundaries during the cooling process after final annealing.

As a result of conducting intensive study to solve this issue, we discovered that in relation with the time during which a secondary recrystallized sheet is retained in a certain temperature range after final annealing, it is effective to control the line tension during the subsequent flattening annealing. It is thought that, as a result, the occurrence of dislocations near crystal grain boundaries of the steel substrate can be effectively suppressed after flattening annealing and that the degradation in magnetic properties occurring due to blockage of domain wall displacement by dislocations can be suppressed.

Based on the above findings, the primary features of our steel sheets and methods for manufacturing the same are described below.

[1] A grain-oriented electrical steel sheet comprising; a steel substrate and a forsterite film on the surface of a steel substrate, wherein the steel substrate comprises a chemical composition containing (consisting of), in mass %, Si: 2.0% to 8.0% and Mn: 0.005% to 1.0% and at least one of Sb: 0.010% to 0.200%, Sn: 0.010% to 0.200%, Mo: 0.010% to 0.200%, Cu: 0.010% to 0.200%, and P: 0.010% to 0.200%, and the balance consisting of Fe and incidental impurities; and a dislocation density near crystal grain boundaries of the steel substrate is $1.0\times10^{13}$ $m^{-2}$ or less.

[2] The grain-oriented electrical steel sheet of [1], wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

[3] A method for manufacturing a grain-oriented electrical steel sheet, the method comprising, in sequence:

subjecting a steel slab to hot rolling to obtain a hot rolled sheet, the steel slab comprising a chemical composition containing (consisting of), in mass %, Si: 2.0% to 8.0% and Mn: 0.005% to 1.0% and at least one of Sb: 0.010% to 0.200%, Sn: 0.010% to 0.200%, Mo: 0.010% to 0.200%, Cu: 0.010% to 0.200%, and P: 0.010% to 0.200%, and the balance consisting of Fe and incidental impurities;

subjecting the hot rolled sheet to hot band annealing as required;

subjecting the hot rolled sheet to cold rolling once or cold rolling twice or more with intermediate annealing in between, to obtain a cold rolled sheet with a final sheet thickness;

subjecting the cold rolled sheet to primary recrystallization annealing to obtain a primary recrystallized sheet;

applying an annealing separator onto a surface of the primary recrystallized sheet and then subjecting the primary recrystallized sheet to final annealing for secondary recrystallization, to obtain a secondary recrystallized sheet that has a forsterite film on a surface of a steel substrate; and subjecting the secondary recrystallized sheet to flattening annealing for 5 seconds or more and 60 seconds or less at a temperature of 750° C. or higher;

wherein during the flattening annealing, Pr is controlled to satisfy the following conditional Expression (1), so that a dislocation density near crystal grain boundaries of the steel substrate is $1.0\times10^{13}$ $m^{-2}$ or less:

$$Pr \leq -0.075T+18 (\text{where } T>10, 5<Pr) \quad (1)$$

where Pr (MPa) is a line tension on the secondary recrystallized sheet, and T (hr) is a time required after the final annealing to reduce a temperature of the secondary recrystallized sheet from 800° C. to 400° C.

[4] The method for manufacturing a grain-oriented electrical steel sheet of [3], wherein during cooling of the secondary recrystallized sheet after the final annealing, the secondary recrystallized sheet is held for 5 hours or longer at a predetermined temperature from 800° C. to 400° C.

[5] The method for manufacturing a grain-oriented electrical steel sheet of [3] or [4], wherein the chemical composition contains, in mass %, Sb: 0.010% to 0.100%, Cu: 0.015% to 0.100%, and P: 0.010% to 0.100%.

[6] The method for manufacturing a grain-oriented electrical steel sheet of any one of [3] to [5], wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

[7] The method for manufacturing a grain-oriented electrical steel sheet of any one of [3] to [6], wherein the chemical composition further contains, in mass %, C: 0.010% to 0.100%, Al: 0.01% or less, N: 0.005% or less, S: 0.005% or less, and Se: 0.005% or less.

[8] The method for manufacturing a grain-oriented electrical steel sheet of any one of [3] to [6], wherein the chemical composition further contains, in mass %, C: 0.010% to 0.100%; and at least one of (i) Al: 0.010% to 0.050% and N: 0.003% to 0.020%, and (ii) S: 0.002% to 0.030% and/or Se: 0.003% to 0.030%.

The line tension during flattening annealing is referred to in JP 2012-177162 A (PTL 3) and JP 2012-36447 A (PTL 4), but these techniques are for preventing degradation of the tensile tension of forsterite film and differ substantially from this disclosure, which proposes to reduce dislocations in the steel substrate. We focus on controlling the relationship we newly discovered between the time required after final annealing to reduce the temperature of a secondary recrystallized sheet from 800° C. to 400° C. (hereinafter also referred to as the "retention time from 800° C. to 400° C. after final annealing") and the line tension during flattening annealing.

Advantageous Effect

Since the dislocation density near crystal grain boundaries of the steel substrate is $1.0\times10^{13}$ $m^{-2}$ or less, our grain-oriented electrical steel sheet has low iron loss even when containing at least one of Sb, Sn, Mo, Cu, and P, which are grain boundary segregation elements.

Our method for manufacturing a grain-oriented electrical steel sheet optimizes the line tension Pr (MPa) on the secondary recrystallized sheet during flattening annealing in relation to the retention time T (hr) from 800° C. to 400° C. after final annealing. Therefore, a grain-oriented electrical steel sheet in which iron loss is low and the dislocation density near crystal grain boundaries of the steel substrate is a low value of $1.0\times10^{13}$ $m^{-2}$ or less can be obtained even when the grain-oriented electrical steel sheet contains at least one of Sb, Sn, Mo, Cu, and P.

DETAILED DESCRIPTION

The following describes the experiments by which the present disclosure has been completed.

<Experiment 1>

A steel slab A containing, in mass %, C: 0.063%, Si: 3.35%, Mn: 0.09%, S: 0.0032%, N: 0.0020%, and sol.Al: 0.0044%, and a steel slab B containing, in mass %, C: 0.065%, Si: 3.33%, Mn: 0.09%, S: 0.0030%, N: 0.0028%, sol.Al: 0.0048%, and Sb: 0.037% were manufactured by continuous casting and subjected to slab reheating to 1200° C. Subsequently, these steel slabs were subjected to hot rolling and finished to hot rolled sheets with a sheet thickness of 2.0 mm. Thereafter, the hot rolled sheets were subjected to hot band annealing for 40 seconds at 1050° C. and then finished to cold rolled sheets with a sheet thickness of 0.23 mm by cold rolling. Furthermore, the cold rolled sheets were subjected to primary recrystallization annealing, which also served as decarburization annealing, for 130 seconds at 840° C. in a 50% $H_2$/50% $N_2$ wet atmosphere with a dew point of 60° C. to obtain primary recrystallized sheets. Subsequently, an annealing separator primarily composed of MgO was applied onto a surface of the primary recrystallized sheets and then the primary recrystallized sheets were subjected to final annealing for secondary recrystallization by holding for 10 hours at 1200° C. in an $H_2$ atmosphere, to obtain a secondary recrystallized sheet. The retention time T (hr) from 800° C. to 400° C. after the final annealing was set to 40 hours. In this disclosure, the "temperature of the secondary recrystallized sheet" refers to the temperature measured at an intermediate position between the innermost turn and the outermost turn on the edge face of a coil of the secondary recrystallized sheet (the edge face being the lowermost portion when the coil is stood on end).

Furthermore, for shape adjustment, the secondary recrystallized sheets were subjected to flattening annealing for 30 seconds at 830° C. to obtain product sheets. At this time, the line tension Pr (MPa) on the secondary recrystallized sheets was changed to a variety of values. In this disclosure, the "line tension" refers to the tensile tension applied to the secondary recrystallized sheet mainly in order to prevent meandering during sheet passing through a continuous annealing furnace and is controlled by bridle rolls before and after the annealing furnace.

Figure 1:
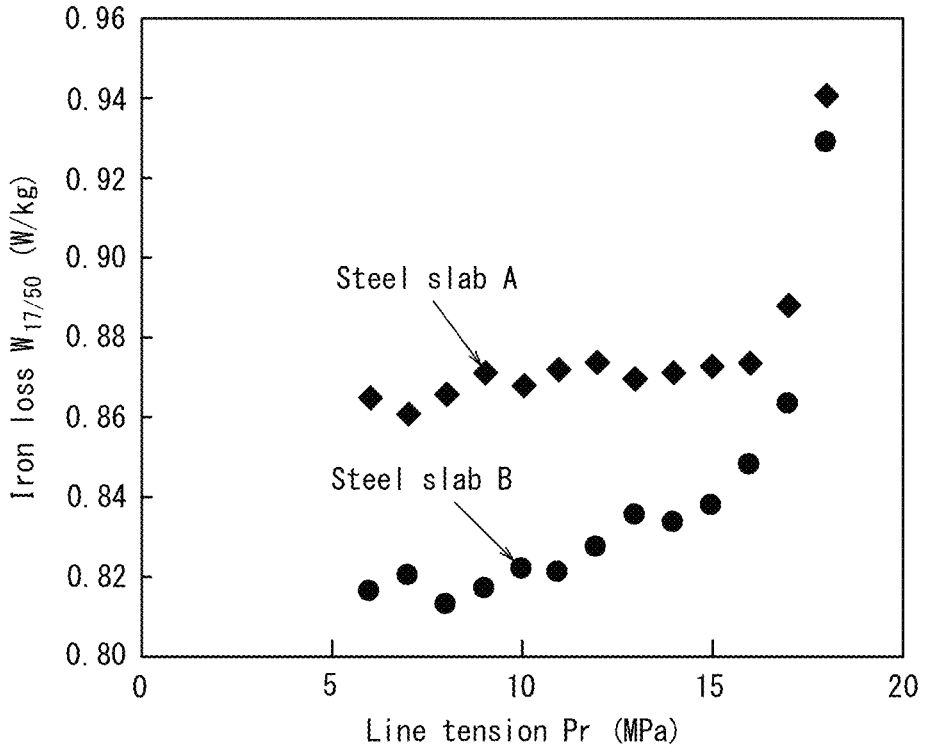
FIG. 1 illustrates the relationship between the line tension Pr (MPa) on the secondary recrystallized sheet during flattening annealing and the iron loss $W_{17/50}$ (W/kg) of the product sheet in Experiment 1.

The iron loss $W_{17/50}$ (iron loss upon 1.7 T excitation at a frequency of 50 Hz) of the resulting product sheet was measured with the method prescribed by JIS C2550. FIG. 1 illustrates the results. These results show that in the case of the steel slab B containing Sb, the iron loss $W_{17/50}$ of the product sheet could be reduced sufficiently, as compared to the steel slab A, when the line tension Pr was set to 15 MPa or less. For both steel slabs A and B, creep deformation occurred in the product sheet at a line tension of 18 MPa, which was thought to be the reason for serious degradation in the magnetic properties.

Upon performing component analysis on the steel substrate of these product sheets, the C content was reduced to approximately 12 mass ppm, and the S, N, and sol.Al contents changed to less than 4 mass ppm (below the analytical limit) for both steel slabs A and B, but the Si, Mn, and Sb contents were nearly equivalent to the contents in the slabs. The component analysis of the steel substrates was performed once the product sheets were dried after being immersed for two minutes in a 10% HCl aqueous solution at 80° C. to remove the forsterite film of the product sheets. These results show that sulfides and nitrides that degrade magnetic properties did not precipitate, indicating that precipitates could not easily be the cause of degradation.

Figure 2:
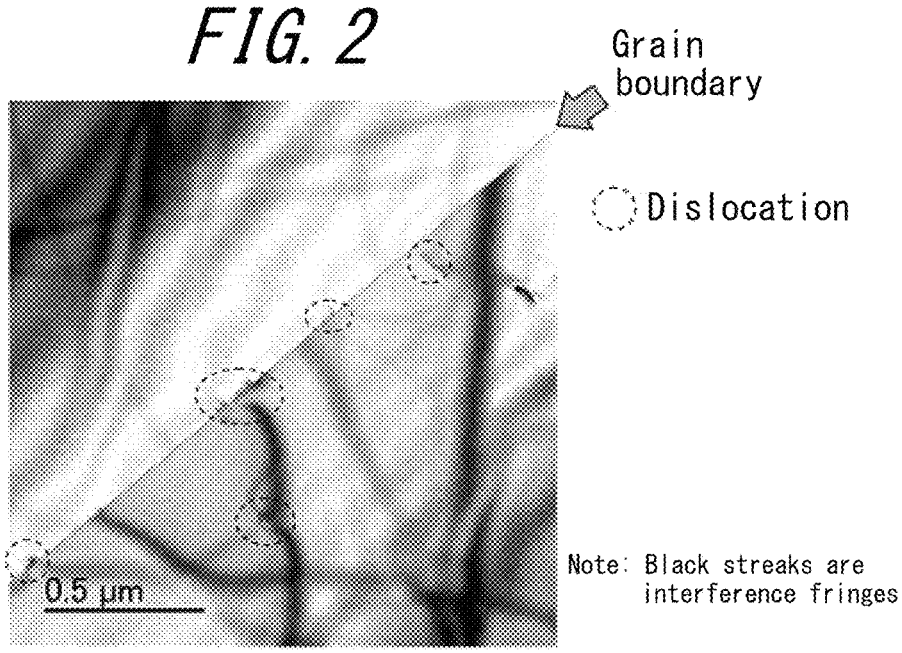
FIG. 2 is a TEM image near the grain boundary of the product sheet when the line tension Pr is 16 MPa using steel slab B in Experiment 1.
Figure 3:
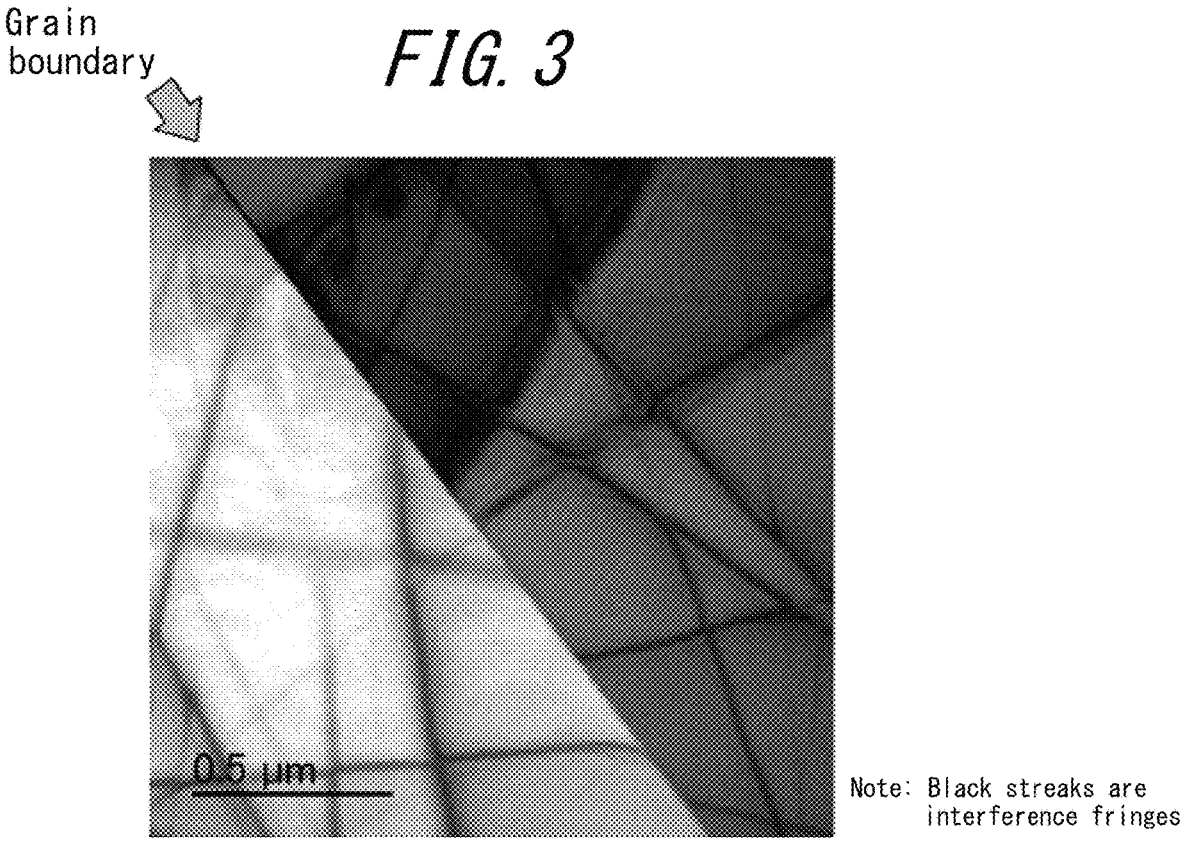
FIG. 3 is a TEM image near the grain boundary of the product sheet when the line tension Pr is 8 MPa using steel slab B in Experiment 1.

Next, in the case of the steel slab B that includes the grain boundary segregation element Sb, the area near crystal grain boundaries of the steel substrate of the product sheet was observed using a transmission electron microscope (TEM) (JEM-2100F produced by JEOL) in order to discover why iron loss of the product sheet reduces as the line tension Pr is decreased. As a result, it became clear that when the line tension Pr is set to 16 MPa, several dislocations are present at and near the grain boundary, as illustrated in FIG. 2. The area of this field was 2.2 $\mu m^2$, and 5 dislocations were observable. Therefore, the dislocation density in this observation field was approximately $2.3\times10^{12}$ $m^{-2}$, and the average of 10 fields exceeded $1.0\times10^{13}$ $m^{-2}$. On the other hand, when the line tension Pr was set to 8 MPa, there were almost no dislocations present, and the dislocation density in this observation field was calculated as 0, as illustrated in FIG. 3. Hence, it is presumed that when the grain boundary segregation element Sb is included in the steel slab, dislocations easily accumulate at the grain boundary if the line tension Pr is high, leading to degradation in magnetic properties.

During final annealing of the grain-oriented electrical steel sheet, batch annealing is typically performed with the primary recrystallized sheets in a coiled state. Therefore, after holding at approximately 1200° C., secondary recrystallized sheets are cooled. Note that the retention time from 800° C. to 400° C. after final annealing can be changed and controlled by controlling the flow of the atmosphere.

Accordingly, segregation of a grain boundary segregation element to the grain boundary is freed during final annealing, and the grain boundary segregation element dissolves in the crystal grains, but if the subsequent cooling process is lengthy, then the grain boundary segregation element may segregate to the grain boundary at that time. In other words, it is thought that if the cooling rate is slow, the amount of segregation increases, and magnetic properties further degrade during the subsequent flattening annealing if the line tension Pr is high. Therefore, we examined the effect on the magnetic properties due to the retention time at the time of final annealing from 800° C. to 400° C. and the line tension Pr during the flattening annealing.

<Experiment 2>

A steel slab C containing, in mass %, C: 0.048%, Si: 3.18%, Mn: 0.14%, S: 0.0020%, N: 0.0040%, sol.Al: 0.0072%, and Sb: 0.059% was manufactured by continuous casting and subjected to slab reheating to 1220° C. Subsequently, the steel slab was subjected to hot rolling and finished to a hot rolled sheet with a sheet thickness of 2.2 mm. Thereafter, the hot rolled sheet was subjected to hot band annealing for 30 seconds at 1025° C. and then finished to a cold rolled sheet with a sheet thickness of 0.27 mm by cold rolling. Furthermore, the cold rolled sheet was subjected to primary recrystallization annealing, which also served as decarburization annealing, for 100 seconds at 850° C. in a 50% $H_2$/50% $N_2$ wet atmosphere with a dew point of 62° C. to obtain a primary recrystallized sheet. Subsequently, an annealing separator primarily composed of MgO was applied onto a surface of the primary recrystallized sheet and then the primary recrystallized sheet was subjected to final annealing for secondary recrystallization by holding for 10 hours at 1200° C. in an $H_2$ atmosphere, to obtain a secondary recrystallized sheet. At this time, the cooling rate after the final annealing was varied to change the retention time T (hr) from 800° C. to 400° C. to a variety of values.

Furthermore, for shape adjustment, the secondary recrystallized sheet was subjected to flattening annealing for 15 seconds at 840° C. to obtain a product sheet. At this time, the line tension Pr (MPa) on the secondary recrystallized sheet was changed to a variety of values. At a line tension Pr of 5 MPa or less, however, the secondary recrystallized sheet meandered, and regular sheet passing could not be performed. Therefore, the minimum line tension was set above 5 MPa.

Figure 4:
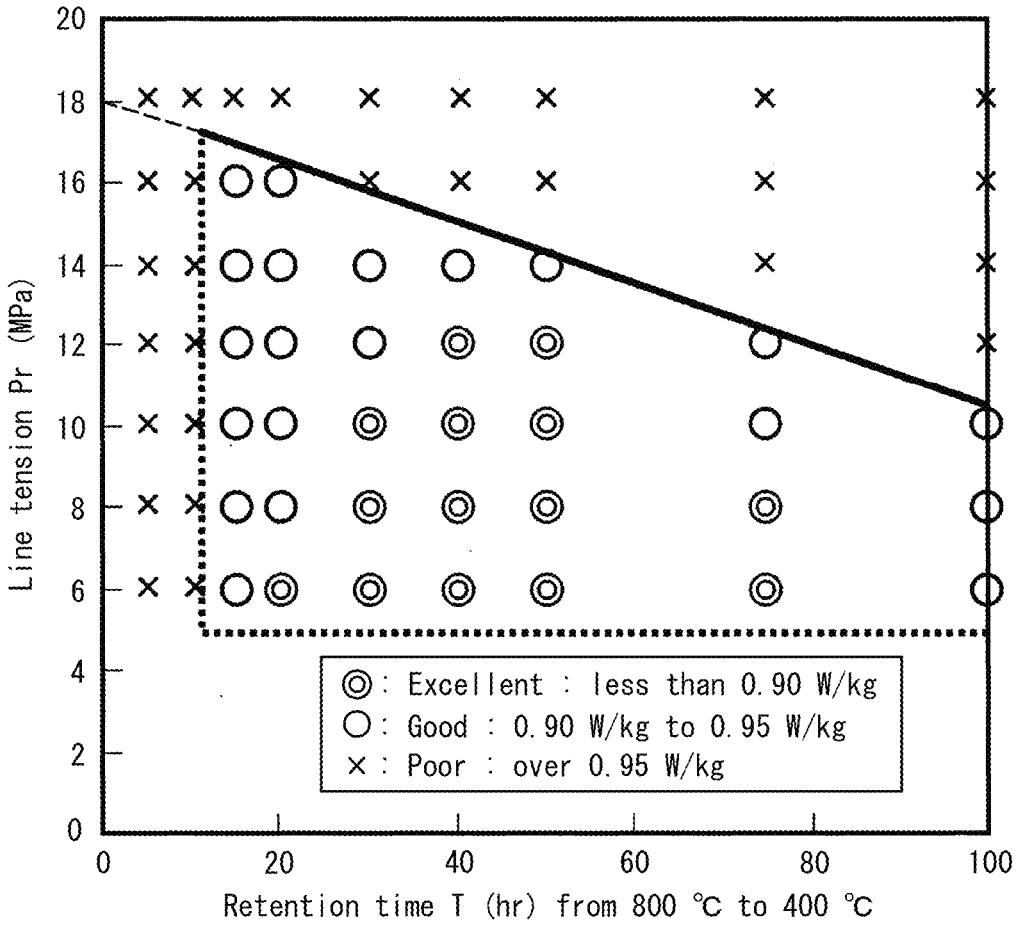
FIG. 4 represents the effects on the iron loss $W_{17/50}$ (W/kg) of the product sheet due to the retention time T (hr) from 800° C. to 400° C. after final annealing and the line tension Pr (MPa) on the secondary recrystallized sheet during flattening annealing in Experiment 2.

The iron loss $W_{17/50}$ of the resulting product sheet was measured with the method prescribed by JIS C2550. FIG. 4 illustrates the results. These results show that an increase in length of the retention time T from 800° C. to 400° C. after final annealing decreases the upper limit of the line tension Pr during the flattening annealing at which low iron loss is expressed.

Figure 5:
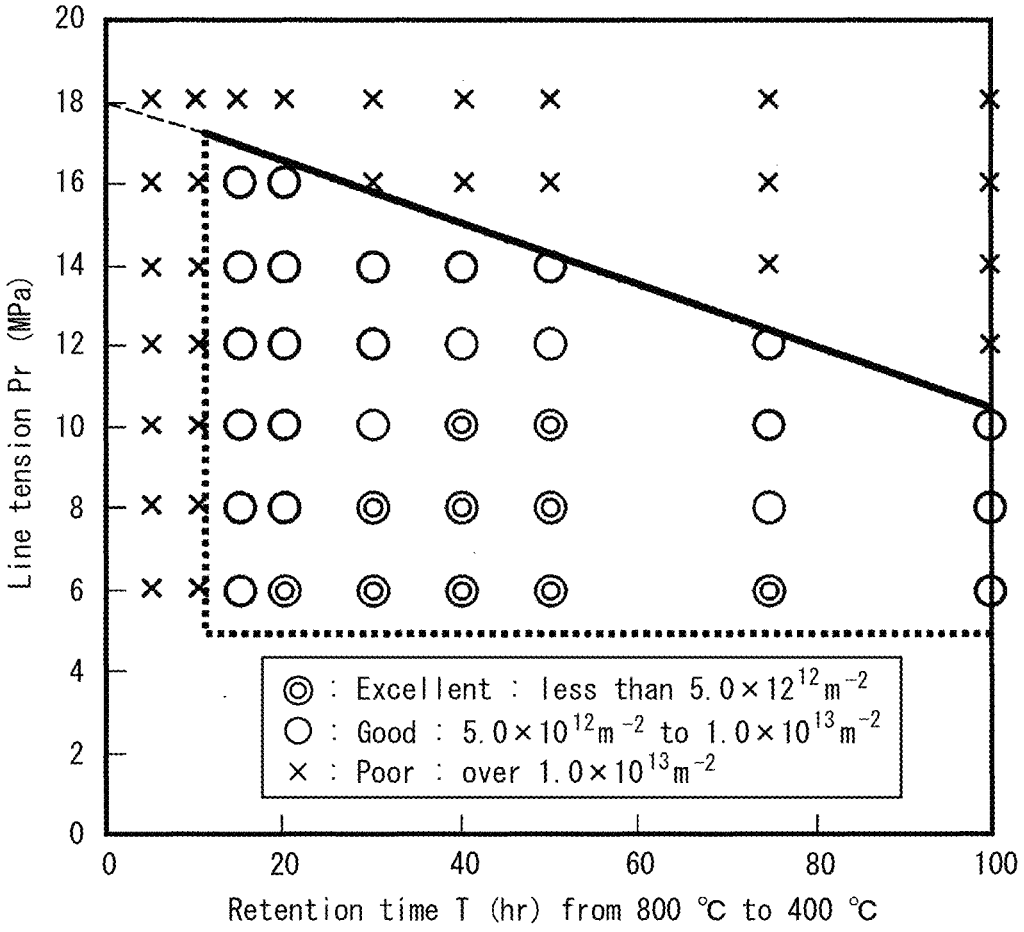
FIG. 5 represents the effects on the dislocation density ($m^{-2}$) near crystal grain boundaries of the steel substrate of the product sheet due to the retention time T (hr) from 800° C. to 400° C. after final annealing and the line tension Pr (MPa) on the secondary recrystallized sheet during flattening annealing in Experiment 2.

One possible explanation is that, as considered in Experiment 1, in a state in which the grain boundary segregation element is segregated at the grain boundary, the magnetic properties may degrade as a result of accumulation of dislocations at grain boundaries due to application of line tension. In other words, it could be that due to final annealing at 1200° C. for an extended time, the grain boundary segregation element also redissolves in the grains and then resegregates at the grain boundaries during the cooling process. A reasonable explanation is that at this time, as the retention time grows longer in the temperature range of 800° C. to 400° C., in which segregation easily occurs and atoms also easily diffuse, the amount of segregation at the grain boundaries increases, and dislocations occurring near the grain boundaries also increase during the flattening annealing, causing the upper limit of the line tension to decrease. This explanation is supported by FIG. 5.

In this way, in a method for manufacturing a grain-oriented electrical steel sheet that includes a grain boundary segregation element in a steel slab, we succeeded in effectively reducing the dislocation density near crystal grain boundaries of the steel substrate of a product sheet to $1.0\times10^{13}$ $m^{-2}$ or less and in preventing degradation of magnetic properties by controlling the line tension Pr, in relation with the retention time T from 800° C. to 400° C. after final annealing, during the subsequent flattening annealing.

The following describes our grain-oriented electrical steel sheet in detail. First, the reasons for limiting the contents of the components of the chemical composition will be explained. Unless otherwise specified, all concentrations stated herein as "%" and "ppm" refer to mass % and mass ppm.

Si: 2.0% to 8.0%

Si is a necessary element for increasing the specific resistance of a grain-oriented electrical steel sheet and for reducing the iron loss. This effect is not sufficient if the Si content is less than 2.0%, but upon the content exceeding 8.0%, the workability reduces, making rolling for steel manufacturing difficult. Therefore, the Si content is set to be 2.0% or more and 8.0% or less. The Si content is preferably 2.5% or more and is preferably 4.5% or less.

Mn: 0.005% to 1.0%

Mn is an element necessary for improving the hot workability of steel. This effect is not sufficient if the Mn content is less than 0.005%, but upon the content exceeding 1.0%, the magnetic flux density of the product sheet reduces. Therefore, the Mn content is set to be 0.005% or more and 1.0% or less. The Mn content is preferably 0.02% or more and is preferably 0.30% or less.

In this disclosure, in order to improve magnetic properties, it is necessary for the steel sheet to include at least one of Sb, Sn, Mo, Cu, and P, which are grain boundary segregation elements. The effect of improving magnetic properties is limited when the added amount of each element is less than 0.010%, but when the added amount exceeds 0.200%, the saturation magnetic flux density decreases, canceling out the effect of improving magnetic properties. Therefore, the content of each element is set to be 0.010% or more and 0.200% or less. The content of each element is preferably 0.020% or more and is preferably 0.100% or less. In order to prevent the steel sheet from becoming brittle, the Sn and P contents is preferably 0.020% or more and is preferably 0.080% or less. The effect of improving magnetic properties is extremely high if the steel sheet simultaneously contains Sb: 0.010% to 0.100%, Cu: 0.015% to 0.100%, and P: 0.010% to 0.100%.

The balance other than the aforementioned components consists of Fe and incidental impurities, but the steel sheet may optionally contain the following elements.

In order to reduce iron loss, the steel sheet may contain at least one of Ni: 0.010% to 1.50%, Cr: 0.01% to 0.50%, Bi: 0.005% to 0.50%, Te: 0.005% to 0.050%, and Nb: 0.0010% to 0.0100%. If the added amount of each element is less than the lower limit, the effect of reducing iron loss is small, whereas exceeding the upper limit leads to a reduction in magnetic flux density and degradation of magnetic properties.

Here, even when C is intentionally contained in the steel slab, as a result of decarburization annealing the amount of C is reduced to be 0.005% or less, a level at which magnetic aging does not occur. Therefore, even when contained in this range, C is considered an incidental impurity.

Our grain-oriented electrical steel sheet has a dislocation density near crystal grain boundaries of the steel substrate of $1.0\times10^{13}$ $m^{-2}$ or less. Dislocations cause a rise in iron loss by blocking domain wall displacement. By having a low dislocation density, however, our grain-oriented electrical steel sheet has low iron loss. The dislocation density is preferably $5.0\times10^{12}$ $m^{-2}$ or less. It is thought that fewer dislocations are better, and therefore the lower limit is zero. In this context, "near grain boundaries" is defined as a region with 1 m of a grain boundary. The "dislocation density near crystal grain boundaries" in this disclosure was calculated as follows. First, the product sheet was immersed for 3 minutes in a 10% HCl aqueous solution at 80° C. to remove the film and was then chemically polished to produce a thin film sample. The areas near grain boundaries of this sample were observed using a transmission electron microscope (JEM-2100F produced by JEOL) at 50,000× magnification, and the number of dislocations near the grain boundaries in the field of view was divided by the field area. The average for 10 fields was then taken as the "dislocation density."

Next, the method of manufacturing our grain-oriented electrical steel sheet will be described. Within the chemical composition of the steel slab, the elements Si, Mn, Sn, Sb, Mo, Cu, and P and the optional elements Ni, Cr, Bi, Te, and Nb are as described above. The content of these elements does not easily vary during the sequence of processes. Therefore, the amounts are controlled at the stage of component adjustment in the molten steel.

The balance other than the aforementioned components in the steel slab consists of Fe and incidental impurities, but the following elements may optionally be contained.

C: 0.010% to 0.100%

C has the effect of strengthening grain boundaries. This effect is sufficiently achieved if the C content is 0.010% or greater, and there is no risk of cracks in the slab. On the other hand, if the C content is 0.100% or less, then during decarburization annealing, the C content can be reduced to 0.005 mass % or less, a level at which magnetic aging does not occur. Therefore, the C content is preferably set to be 0.010% or more and is preferably set to 0.100% or less. The C content is more preferably 0.020% or more and is more preferably 0.080% or less.

Furthermore, as inhibitor components, the steel slab may contain at least one of (i) Al: 0.010% to 0.050% and N: 0.003% to 0.020%, and (ii) S: 0.002% to 0.030% and/or Se: 0.003% to 0.030%. When the added amount of each component is the lower limit or greater, the effect of improving magnetic flux density by inhibitor formation is sufficiently achieved. By setting the added amount to be the upper limit or lower, the components are purified from the steel substrate during final annealing, and iron loss is not reduced.

When adopting a technique to improve magnetic flux density in an inhibitor free chemical composition, however, these components need not be contained. In this case, components are suppressed to the following contents: Al: 0.01% or less, N: 0.005% or less, S: 0.005% or less, and Se: 0.005% or less.

Molten steel subjected to a predetermined component adjustment as described above may be formed into a steel slab by regular ingot casting or continuous casting, or a thin slab or thinner cast steel with a thickness of 100 mm or less may be produced by direct casting. In accordance with a conventional method, for example the steel slab is preferably heated to approximately 1400° C. when containing inhibitor components and is preferably heated to a temperature of 1250° C. or less when not containing inhibitor components. Thereafter, the steel slab is subjected to hot rolling to obtain a hot rolled sheet. When not containing inhibitor components, the steel slab may be subjected to hot rolling immediately after casting, without being reheated. Also, a thin slab or thinner cast steel may be hot rolled or may be sent directly to the next process, skipping hot rolling.

Next, the hot rolled sheet is subjected to hot band annealing as necessary. This hot band annealing is preferably performed under the conditions of a soaking temperature of 800° C. or higher and 1150° C. or lower and a soaking time of 2 seconds or more and 300 seconds or less. If the soaking temperature is less than 800° C., a band texture formed during hot rolling remains, which makes it difficult to obtain a primary recrystallization texture of uniformly-sized grains and impedes the growth of secondary recrystallization. On the other hand, if the soaking temperature exceeds 1150° C., the grain size after the hot band annealing becomes too coarse and makes it difficult to obtain a primary recrystallized texture of uniformly-sized grains. Furthermore, if the soaking time is less than 2 seconds, non-recrystallized parts remain and a desirable microstructure might not be obtained. On the other hand, if the soaking time exceeds 300 seconds, dissolution of AlN, MnSe, and MnS proceeds, and the effect of the minute amount inhibitor may decrease.

After hot band annealing, the hot rolled sheet is subjected to cold rolling once or, as necessary, cold rolling twice or more with intermediate annealing in between, to obtain a cold rolled sheet with a final sheet thickness. The intermediate annealing temperature is preferably 900° C. or higher and is preferably 1200° C. or lower. If the annealing temperature is less than 900° C., the recrystallized grains become smaller and the number of Goss nuclei decreases in the primary recrystallized texture, which may cause the magnetic properties to degrade. If the annealing temperature exceeds 1200° C., the grain size coarsens too much, as with hot band annealing. In order to change the recrystallization texture and improve magnetic properties, it is effective to increase the temperature during final cold rolling to between 100° C. and 300° C. and to perform aging treatment in a range of 100° C. to 300° C. one or multiple times during cold rolling.

Next, the cold rolled sheet is subjected to primary recrystallization annealing (which also serves as decarburization annealing when including C in the steel slab) to obtain a primary recrystallized sheet. An intermediate annealing temperature of 800° C. or higher and 900° C. or lower is effective in terms of decarburization. Furthermore, the atmosphere is preferably a wet atmosphere in terms of decarburization. This does not apply, however, when decarburization is unnecessary. The Goss nuclei increase if the heating rate to the soaking temperature is fast. Therefore, a heating rate of 50° C./s or higher is preferable. If the heating rate is too fast, however, the primary orientation such as {111}<112> decreases in the primary recrystallized texture. Therefore, the heating rate is preferably 400° C./s or less.

Next, an annealing separator primarily composed of MgO is applied onto a surface of the primary recrystallized sheet and then the primary recrystallized sheet is subjected to final annealing for secondary recrystallization, to obtain a secondary recrystallized sheet that has a forsterite film on a surface of a steel substrate. The final annealing is preferably held for 20 hours or longer at a temperature of 800° C. or higher in order to complete secondary recrystallization. Also, the final annealing is preferably performed at a temperature of approximately 1200° C. for forsterite film formation and steel substrate purification. The cooling process after soaking is used to measure the retention time T from 800° C. to 400° C. and to control the line tension Pr in the next step of flattening annealing. If the retention time T is too long, however, the temperature distribution in the coil becomes unbalanced, and the difference between the coolest point and the hottest point increases. A difference in thermal expansion then occurs due to this temperature difference, and a large stress occurs inside the coil, causing the magnetic properties to degrade. Therefore, the retention time T needs to exceed 10 hours. In terms of productivity and of suppressing diffusion of segregation elements to the grain boundaries, the retention time T is also preferably 80 hours or less.

Furthermore, during cooling of the secondary recrystallized sheet after the final annealing, good magnetic properties can be obtained even when shortening the cooling time by adopting a pattern that holds the secondary recrystallized sheet for five hours or longer at a predetermined constant temperature from 800° C. to 400° C. The reason is that unevenness of the temperature distribution within the coil is resolved, and diffusion of segregation elements to the grain boundaries can be suppressed, allowing improvement in the magnetic properties. The holding at a constant temperature is preferably not performed only once, but rather holding at a constant temperature is preferably repeated multiple times while lowering the temperature gradually, as in step cooling, since unevenness of the temperature distribution within the coil can be highly resolved.

After final annealing, the secondary recrystallized sheet is preferably washed with water, brushed, and pickled in order to remove annealing separator that has adhered. Subsequently, the secondary recrystallized sheet is subjected to flattening annealing to correct the shape. The flattening annealing temperature is preferably 750° C. or higher, since otherwise the shape adjustment effect is limited. Upon the flattening annealing temperature exceeding 950° C., however, the secondary recrystallized sheet suffers creep deformation during annealing, and the magnetic properties deteriorate significantly. The flattening annealing temperature is preferably 800° C. or higher and is preferably 900° C. or lower. Also, the shape adjustment effect is poor if the soaking time is too short, whereas the secondary recrystallized sheet suffers creep deformation and the magnetic properties deteriorate significantly if the soaking time is too long. Therefore, the soaking time is set to be 5 seconds or longer and 60 seconds or less.

Furthermore, as described above, the line tension Pr (MPa) during the flattening annealing is set to a value of $-0.075\times T+18$ or less in relation to the retention time T (hr) from 800° C. to 400° C. after the final annealing. If the line tension Pr is low, however, meandering occurs during sheet passing, and if the line tension Pr is high, the secondary recrystallized sheet suffers creep deformation and the magnetic properties deteriorate significantly. Therefore, the line tension Pr is set to exceed 5 MPa and to be less than 18 MPa.

For additional reduction in iron loss, it is effective further to apply a tension coating onto the grain-oriented electrical steel sheet surface that has the forsterite film. Adopting a tension coating application method, physical vapor deposition, or a method to form a tension coating by vapor depositing an inorganic material on the steel sheet surface layer by chemical vapor deposition is preferable for yielding excellent coating adhesion and a significant effect of reducing iron loss.

For further reduction in iron loss, magnetic domain refining treatment may be performed. A typically performed method may be adopted as a treatment method, such as a method to form a groove in the final product sheet or to introduce thermal strain or impact strain linearly by a laser or an electron beam, or a method to introduce a groove in advance in an intermediate product such as the cold rolled sheet that has reached the final sheet thickness.

EXAMPLES

Example 1

Steel slabs containing, in mass %, C: 0.032%, Si: 3.25%, Mn: 0.06%, N: 0.0026%, sol.Al: 0.0095%, Sn: 0.120%, and P: 0.029% were manufactured by continuous casting and subjected to slab reheating to 1220° C. Subsequently, the steel slabs were subjected to hot rolling and finished to a hot rolled sheet with a sheet thickness of 2.7 mm. Thereafter, the hot rolled sheets were subjected to hot band annealing for 30 seconds at 1025° C. and then finished to cold rolled sheets with a sheet thickness of 0.23 mm by cold rolling. Subsequently, the cold rolled sheets were subjected to primary recrystallization annealing, which also served as decarburization annealing, for 100 seconds at 840° C. in a 55% $H_2$/45% $N_2$ wet atmosphere with a dew point of 58° C. to obtain primary recrystallized sheets. Subsequently, an annealing separator primarily composed of MgO was applied onto a surface of the primary recrystallized sheets and then the primary recrystallized sheets were subjected to final annealing for secondary recrystallization by holding for 5 hours at 1200° C. in an $H_2$ atmosphere, to obtain a secondary recrystallized sheet. At this time, the cooling rate after the final annealing was varied to change the retention time T from 800° C. to 400° C. as listed in Table 1.

Next, the secondary recrystallized sheets were subjected to flattening annealing for 25 seconds at 860° C. At this time, the line tension Pr was changed to a variety of values as listed in Table 1. Next, one side of each steel sheet was subjected to magnetic domain refining treatment, at an 8 mm pitch, by continuous irradiation of an electron beam perpendicular to the rolling direction. The electron beam was irradiated under the conditions of an accelerating voltage of 50 kV, a beam current of 10 mA, and a scanning rate of 40 m/s.

For the resulting product sheets, the dislocation density was measured with a known method, and the iron loss $W_{17/50}$ was measured with the method prescribed by JIS C2550. The results are shown in Table 1. Table 1 shows that good iron loss properties were obtained at conditions within the ranges of this disclosure.

TABLE 1

| Retention time T (hr) from 800° C. to 400° C. | Value of right-hand side of Expression (1) | Line tension Pr (MPa) | Dislocation density ($m^{-2}$) | Iron loss $W_{17/50}$ (W/kg) | Notes |
|---|---|---|---|---|---|
| 20 | 16.5 | 8 | $5.0 \times 10^{12}$ | 0.692 | Example |
| 20 | 16.5 | 12 | $6.8 \times 10^{12}$ | 0.713 | Example |
| 20 | 16.5 | 16 | $7.7 \times 10^{12}$ | 0.719 | Example |
| 40 | 15.0 | 8 | $1.8 \times 10^{12}$ | 0.687 | Example |
| 40 | 15.0 | 12 | $5.9 \times 10^{12}$ | 0.700 | Example |
| 40 | 15.0 | 16 | $1.1 \times 10^{13}$ | 0.745 | Comparative Example |
| 60 | 13.5 | 8 | $4.1 \times 10^{12}$ | 0.692 | Example |
| 60 | 13.5 | 12 | $9.1 \times 10^{12}$ | 0.715 | Example |
| 60 | 13.5 | 16 | $1.2 \times 10^{13}$ | 0.742 | Comparative Example |
| 100 | 10.5 | 8 | $9.1 \times 10^{12}$ | 0.711 | Example |
| 100 | 10.5 | 12 | $1.2 \times 10^{13}$ | 0.748 | Comparative Example |
| 100 | 10.5 | 16 | $1.8 \times 10^{13}$ | 0.765 | Comparative Example |

Underlined values are outside of the range of the present disclosure

Component analysis was performed on the steel substrate of the product sheets with the same method as in Experiment 1. As a result, in each product sheet, the C content was reduced to approximately 8 ppm, and the N and sol.Al contents were reduced to less than 4 ppm (below the analytical limit), whereas Si, Mn, Sn, and P contents were nearly equivalent to the contents in the slab.

Example 2

A variety of steel slabs containing the components listed in Table 2 were manufactured by continuous casting and subjected to slab reheating to 1380° C. Subsequently, these steel slabs were subjected to hot rolling and finished to hot rolled sheets with a thickness of 2.5 mm. Thereafter, the hot rolled sheets were subjected to hot band annealing for 30 seconds at 950° C. and then formed to a sheet thickness of 1.7 mm by cold rolling. The hot rolled sheets were then subjected to intermediate annealing for 30 seconds at 1100° C. and then finished to cold rolled sheets with a sheet thickness of 0.23 mm by warm rolling at 100° C. Subsequently, the cold rolled sheets were subjected to primary recrystallization annealing, which also served as decarburization annealing, for 100 seconds at 850° C. in a 60% $H_2$/40% $N_2$ wet atmosphere with a dew point of 64° C. to obtain primary recrystallized sheets. Subsequently, an annealing separator primarily composed of MgO was applied onto a surface of the primary recrystallized sheets and then the primary recrystallized sheets were subjected to final annealing for secondary recrystallization by holding for 5 hours at 1200° C. in an $H_2$ atmosphere, to obtain a secondary recrystallized sheet. The retention time T from 800° C. to 400° C. after the final annealing was set to 45 hours.

Next, the secondary recrystallized sheets were subjected to flattening annealing for 10 seconds at 835° C. At this time, the line tension Pr was set to 10 MPa, which is within the range of this disclosure. Next, one side of each steel sheet was subjected to magnetic domain refining treatment, at a 5 mm pitch, by continuous irradiation of an electron beam perpendicular to the rolling direction. The electron beam was irradiated under the conditions of an accelerating voltage of 150 kV, a beam current of 3 mA, and a scanning rate of 120 m/s.

For the resulting product sheets, the dislocation density was measured with a known method and was $1.0\times10^{13}$ $m^{-2}$ or less for all of the product sheets. Furthermore, the iron loss $W_{17/50}$ was measured with the method prescribed by JIS C2550. The results are shown in Table 2. Table 2 shows that good iron loss properties were obtained at conditions within the ranges of this disclosure.

TABLE 2

| Chemical composition (mass %) | | | | | | | | Iron loss $W_{17/50}$ | |
|---|---|---|---|---|---|---|---|---|---|
| Si | Mn | Sb | Sn | Mo | Cu | P | Other | (W/kg) | Notes |
| 3.21 | 0.07 | 0.071 | — | — | — | — | — | 0.702 | Example |
| 3.36 | 0.06 | — | 0.078 | — | — | — | — | 0.713 | Example |
| 3.38 | 0.07 | — | — | 0.025 | — | — | — | 0.715 | Example |
| 3.35 | 0.07 | — | — | — | 0.039 | — | — | 0.709 | Example |
| 3.21 | 0.10 | — | — | — | — | 0.051 | — | 0.721 | Example |
| 3.20 | 0.09 | 0.123 | 0.036 | 0.035 | 0.050 | 0.011 | — | 0.690 | Example |
| 1.77 | 0.15 | 0.039 | — | — | — | — | — | 1.535 | Comparative Example |
| 3.29 | 1.53 | 0.046 | — | — | — | — | — | 2.808 | Comparative Example |
| 3.28 | 0.11 | 0.051 | — | — | — | — | C: 0.062 | 0.698 | Example |
| 3.25 | 0.07 | 0.049 | — | — | — | — | C: 0.025, Al: 0.024, N: 0.012 | 0.692 | Example |
| 3.37 | 0.08 | 0.048 | — | — | — | — | S: 0.004, Cr: 0.05, Bi: 0.020 | 0.695 | Example |
| 3.30 | 0.09 | 0.048 | — | — | — | — | Se: 0.016, Ni: 0.06, Te: 0.009 | 0.700 | Example |
| 2.98 | 0.11 | 0.053 | — | — | — | — | C: 0.066, Nb: 0.004 | 0.698 | Example |
| 3.11 | 0.15 | 0.039 | 0.022 | 0.022 | 0.075 | 0.072 | C: 0.035, Cr: 0.04 | 0.675 | Example |

Underlined values are outside of the range of the present disclosure

Component analysis was performed on the steel substrate of the product sheets with the same method as in Experiment 1. As a result, in each product sheet, the C content was reduced to 50 ppm or less, the S, N and sol.Al contents were reduced to less than 4 ppm (below the analytical limit), and the Se content was reduced to less than 10 ppm (below the analytical limit), whereas the content of other elements was nearly equivalent to the content in the slab as listed in Table 2.

Example 3

Steel slabs containing, in mass %, C: 0.058%, Si: 3.68%, Mn: 0.34%, N: 0.0011%, sol.Al: 0.0023%, Sb: 0.090%, and P: 0.077% were manufactured by continuous casting and subjected to slab reheating to 1220° C. Subsequently, the steel slabs were subjected to hot rolling and finished to a hot rolled sheet with a sheet thickness of 2.0 mm. Thereafter, the hot rolled sheets were subjected to hot band annealing for 100 seconds at 1060° C. and then finished to cold rolled sheets with a sheet thickness of 0.23 mm by cold rolling. Subsequently, the cold rolled sheets were subjected to primary recrystallization annealing, which also served as decarburization annealing, for 100 seconds at 840° C. in a 55% $H_2$/45% $N_2$ wet atmosphere with a dew point of 60° C. to obtain primary recrystallized sheets. Subsequently, an annealing separator primarily composed of MgO was applied onto a surface of the primary recrystallized sheets and then the primary recrystallized sheets were subjected to final annealing for secondary recrystallization by holding for 5 hours at 1200° C. in an $H_2$ atmosphere, to obtain a secondary recrystallized sheet. One of the following was adopted as the cooling after the final annealing: cooling without holding at a constant temperature (no holding), cooling by holding for 10 hours at 750° C. (holding once), and cooling by holding for two hours each at 800° C., 700° C., 600° C., and 500° C. (holding four times). During holding once and holding four times, the unevenness in temperature inside the coil was resolved. Therefore, as the number of retentions was greater, the cooling rate outside of the retention was accelerated. As a result, the retention time T from 800° C. to 400° C. was 40 hours for no holding, 30 hours when holding once, and 20 hours when holding four times.

Next, the secondary recrystallized sheets were subjected to flattening annealing for 25 seconds at 860° C. At this time, the line tension Pr was changed to a variety of values as listed in Table 3.

For the resulting product sheets, the dislocation density was measured with a known method, and the iron loss $W_{17/50}$ was measured with the method prescribed by JIS C2550. The results are shown in Table 3. Table 3 shows that good iron loss properties were obtained at conditions within the ranges of this disclosure.

TABLE 3

| Cooling method | Retention time T (hr) from 800° C. to 400° C. | Value of right-hand side of Expression (1) | Line tension Pr (MPa) | Dislocation density ($m^{-2}$) | Iron loss $W_{17/50}$ (W/kg) | Notes |
|---|---|---|---|---|---|---|
| No holding | 40 | 15.0 | 6 | $4.9\times10^{12}$ | 0.834 | Example |
| No holding | 40 | 15.0 | 12 | $6.8\times10^{12}$ | 0.841 | Example |
| No holding | 40 | 15.0 | 18 | $1.4\times10^{13}$ | 0.890 | Comparative Example |

TABLE 3-continued

| Cooling method | Retention time T (hr) from 800° C. to 400° C. | Value of right-hand side of Expression (1) | Line tension Pr (MPa) | Dislocation density ($m^{-2}$) | Iron loss $W_{17/50}$ (W/kg) | Notes |
|---|---|---|---|---|---|---|
| Holding once | 30 | 15.75 | 6 | $4.1 \times 10^{12}$ | 0.817 | Example |
| Holding once | 30 | 15.75 | 12 | $4.5 \times 10^{12}$ | 0.824 | Example |
| Holding once | 30 | 15.75 | 18 | $1.4 \times 10^{13}$ | 0.888 | Comparative Example |
| Holding four times | 20 | 16.5 | 6 | $2.7 \times 10^{12}$ | 0.805 | Example |
| Holding four times | 20 | 16.5 | 12 | $3.6 \times 10^{12}$ | 0.809 | Example |
| Holding four times | 20 | 16.5 | 18 | $1.6 \times 10^{13}$ | 0.892 | Comparative Example |

Underlined values are outside of the range of the present disclosure

Component analysis was performed on the steel substrate of the product sheets with the same method as in Experiment 1. As a result, in each product sheet, the C content was reduced to 10 ppm, and the N and sol.Al contents were reduced to less than 4 ppm (below the analytical limit), whereas Si, Mn, Sb, and P contents were nearly equivalent to the contents in the slab.

INDUSTRIAL APPLICABILITY

We can provide a grain-oriented electrical steel sheet with low iron loss even when including at least one of Sb, Sn, Mo, Cu, and P, which are grain boundary segregation elements, and a method for manufacturing the same.

The invention claimed is:

1. A grain-oriented electrical steel sheet comprising; a steel substrate and a forsterite film on a surface of the steel substrate, wherein the steel substrate comprises a chemical composition containing, in mass %, Si: 2.0% to 8.0% and Mn: 0.005% to 1.0% and at least one of Sb: 0.010% to 0.200%, Sn: 0.010% to 0.200%, Mo: 0.010% to 0.200%, Cu: 0.010% to 0.200%, and P: 0.010% to 0.200%, and the balance being Fe and incidental impurities; and a dislocation density near crystal grain boundaries of the steel substrate is $5.0\times10^{12}$ $m^{-2}$ or less.

2. The grain-oriented electrical steel sheet of claim 1, wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

3. A method for manufacturing a grain-oriented electrical steel sheet, the method comprising, in sequence:

subjecting a steel slab to hot rolling to obtain a hot rolled sheet, the steel slab comprising a chemical composition containing, in mass %, Si: 2.0% to 8.0% and Mn: 0.005% to 1.0% and at least one of Sb: 0.010% to 0.200%, Sn: 0.010% to 0.200%, Mo: 0.010% to 0.200%, Cu: 0.010% to 0.200%, and P: 0.010% to 0.200%, and the balance being Fe and incidental impurities;

subjecting the hot rolled sheet to hot band annealing as required;

subjecting the hot rolled sheet to cold rolling once or cold rolling twice or more with intermediate annealing in between, to obtain a cold rolled sheet with a final sheet thickness;

subjecting the cold rolled sheet to primary recrystallization annealing to obtain a primary recrystallized sheet;

applying an annealing separator onto a surface of the primary recrystallized sheet and then subjecting the primary recrystallized sheet to final annealing for secondary recrystallization, to obtain a secondary recrystallized sheet that has a forsterite film on a surface of a steel substrate;

measuring a retention time T in hr which is a time required after the final annealing to reduce a temperature of the secondary recrystallized sheet from 800° C. to 400° C.; and subjecting the secondary recrystallized sheet to flattening annealing for 5 seconds or more and 60 seconds or less at a temperature of 750° C. or higher;

wherein during the flattening annealing, a line tension Pr in MPa on the secondary recrystallized sheet is controlled based on the measured retention time T in hr to satisfy the following conditional Expression (1), so that a dislocation density near crystal grain boundaries of the steel substrate is $5.0\times10^{12}$ $m^{-2}$ or less:

$$Pr \leq -0.075T+18 \text{ wherein } T>10 \text{ and } 5<Pr \quad (1).$$

4. The method for manufacturing a grain-oriented electrical steel sheet of claim 3, wherein during cooling of the secondary recrystallized sheet after the final annealing, the secondary recrystallized sheet is held for 5 hours or longer at a predetermined temperature from 800° C. to 400° C.

5. The method for manufacturing a grain-oriented electrical steel sheet of claim 3, wherein the chemical composition contains, in mass %, Sb: 0.010% to 0.100%, Cu: 0.015% to 0.100%, and P: 0.010% to 0.100%.

6. The method for manufacturing a grain-oriented electrical steel sheet of claim 4, wherein the chemical composition contains, in mass %, Sb: 0.010% to 0.100%, Cu: 0.015% to 0.100%, and P: 0.010% to 0.100%.

7. The method for manufacturing a grain-oriented electrical steel sheet of claim 3, wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

8. The method for manufacturing a grain-oriented electrical steel sheet of claim 4, wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

9. The method for manufacturing a grain-oriented electrical steel sheet of claim 5, wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

10. The method for manufacturing a grain-oriented electrical steel sheet of claim 6, wherein the chemical composition further contains, in mass %, at least one of Ni: 0.010% to 1.50%, Cr: 0.01% to 0.50%, Bi: 0.005% to 0.50%, Te: 0.005% to 0.050%, and Nb: 0.0010% to 0.0100%.

11. The method for manufacturing a grain-oriented electrical steel sheet of claim 3, wherein the chemical composition further contains, in mass %, C: 0.010% to 0.100%, Al: 0.01% or less, N: 0.005% or less, S: 0.005% or less, and Se: 0.005% or less.

12. The method for manufacturing a grain-oriented electrical steel sheet of claim 4, wherein the chemical composition further contains, in mass %, C: 0.010% to 0.100%, Al: 0.01% or less, N: 0.005% or less, S: 0.005% or less, and Se: 0.005% or less.

13. The method for manufacturing a grain-oriented electrical steel sheet of claim 5, wherein the chemical composition further contains, in mass %, C: 0.010% to 0.100%, Al: 0.01% or less, N: 0.005% or less, S: 0.005% or less, and Se: 0.005% or less.

14. The method for manufacturing a grain-oriented electrical steel sheet of claim 7, wherein the chemical composition further contains, in mass %, C: 0.010% to 0.100%, Al: 0.01% or less, N: 0.005% or less, S: 0.005% or less, and Se: 0.005% or less.

15. The method for manufacturing a grain-oriented electrical steel sheet of claim 3, wherein the chemical composition further contains, in mass %, C: 0.010% to 0.100%; and at least one of (i) Al: 0.010% to 0.050% and N: 0.003% to 0.020%, and (ii) S: 0.002% to 0.030% and/or Se: 0.003% to 0.030%.

16. The method for manufacturing a grain-oriented electrical steel sheet of claim 4, wherein the chemical composition further contains, in mass %, C: 0.010% to 0.100%; and at least one of (i) Al: 0.010% to 0.050% and N: 0.003% to 0.020%, and (ii) S: 0.002% to 0.030% and/or Se: 0.003% to 0.030%.

17. The method for manufacturing a grain-oriented electrical steel sheet of claim 5, wherein the chemical composition further contains, in mass %, C: 0.010% to 0.100%; and at least one of (i) Al: 0.010% to 0.050% and N: 0.003% to 0.020%, and (ii) S: 0.002% to 0.030% and/or Se: 0.003% to 0.030%.

18. The method for manufacturing a grain-oriented electrical steel sheet of claim 7, wherein the chemical composition further contains, in mass %, C: 0.010% to 0.100%; and at least one of (i) Al: 0.010% to 0.050% and N: 0.003% to 0.020%, and (ii) S: 0.002% to 0.030% and/or Se: 0.003% to 0.030%.

* * * * *